US005857984A

United States Patent [19]

deBoer et al.

[11] Patent Number: 5,857,984

[45] Date of Patent: Jan. 12, 1999

[54] ABDOMINAL EXERCISE DEVICE & METHOD

[76] Inventors: James A. deBoer, 3679 Pico Rd., Vista, Calif. 92084; Thomas W. Turner, 17722 Falkirk La., Huntington Beach, Calif. 92649

[21] Appl. No.: 846,840

[22] Filed: May 1, 1997

[51] Int. Cl.[6] ..... A61B 5/103; G08B 21/00

[52] U.S. Cl. ..... 600/595; 340/573; 600/594; 482/140; 482/909

[58] Field of Search ..... 128/782, 721; 600/595, 594; 482/140

[56] References Cited

U.S. PATENT DOCUMENTS

| | | | |
|---|---|---|---|
| 2,632,155 | 3/1953 | Lamb . | |
| 3,642,276 | 2/1972 | Kropf | 600/595 X |
| 3,656,158 | 4/1972 | Goodwater . | |
| 4,055,168 | 10/1977 | Miller et al. . | |
| 4,107,464 | 8/1978 | Lynch et al. . | |
| 4,157,540 | 6/1979 | Oros . | |
| 4,162,490 | 7/1979 | Fu et al. . | |
| 4,191,949 | 3/1980 | Myers . | |
| 4,300,129 | 11/1981 | Cataldo . | |
| 4,392,126 | 7/1983 | Loyola | 600/595 X |
| 4,730,625 | 3/1988 | Fraser et al. . | |
| 4,798,538 | 1/1989 | Yagi . | |
| 4,801,921 | 1/1989 | Zigenfus . | |
| 4,846,462 | 7/1989 | Regnier et al. | 600/595 X |
| 4,871,998 | 10/1989 | Chaillou | 600/595 X |
| 4,914,423 | 4/1990 | Fernandez . | |
| 4,989,612 | 2/1991 | Fore | 600/595 X |
| 5,107,855 | 4/1992 | Harrington | 601/595 X |
| 5,168,264 | 12/1992 | Agustin . | |
| 5,295,490 | 3/1994 | Dodakian | 600/595 X |
| 5,304,984 | 4/1994 | Roldan . | |
| 5,469,861 | 11/1995 | Piscopo et al. . | |

*Primary Examiner*—Richard J. Apley
*Assistant Examiner*—William LaMarca
*Attorney, Agent, or Firm*—Connors & Associates; John J. Connors

[57] ABSTRACT

An exercise belt 10 to be worn around the waist of a user has a case 14 holding a control switch S1, a switch actuator 22, a battery 16, a vibrator 20, and a motor 18 connected to the vibrator 20 to cause the vibrator 20 to vibrate upon energization of the motor 18 by the battery 16 when the control switch S1 changes states. A light emitting device 28 is attached to the case 14 and positioned to be observed when the belt 10 is worn around the waist of a user. A strap 12 has one end attached to one end of the case 14 and another end connected to the switch actuator 22. This strap 12 is adjustable to fit snugly around the waist of a user, with expansion of the user's waist moving the switch actuator 22 to change the state of the control switch S1, energizing the motor 18, vibrator 20, and light emitting device 28.

9 Claims, 2 Drawing Sheets

ABDOMINAL EXERCISE DEVICE & METHOD

BACKGROUND OF THE INVENTION

1. Field of the Invention

This invention relates to an exercise belt which is worn about the waist of a user, and provides both a visual and tactile alarm when the user's waist expands beyond a predetermined width.

2. Background Discussion

A wide variety of devices have been suggested that will exercise the abdominal muscles of a user. Belts have been suggested that are worn about the waist of the user that require the user to hold his or her stomach in, preventing the expansion of the waist beyond a predetermined width. If the user fails to keep his or her waist from expanding beyond this predetermined width, an audible alarm is turned on. The disadvantage of an audible alarm is that it disturbs others in the vicinity of the user. Tactile alarms have been suggest to alert only the user when the waist has expanded beyond the predetermined width.

SUMMARY OF THE INVENTION

It is the objective of this invention to provide an exercise belt which, when worn about the waist of a user, provides both a visual and tactile alarm upon the user's waist expanding beyond a predetermined width.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include convenience of use, low cost manufacture, and provision for both a visual and tactile alarm when the user's waist expands beyond a predetermined width.

The first feature of the exercise belt of this invention is that it is adapted to be worn around the waist of a user. It includes a case with a front and rear face which holds a control switch, a switch actuator, a battery, a vibrator, and a motor connected to the vibrator to cause the vibrator to vibrate upon energization of the motor by the battery when the control switch changes states. Preferably, the control switch is of the type that essentially eliminates intermittent contact, so that the switch is either completely on or completely off. The case has an inside wall which abuts the stomach of the user at the user's front, central stomach area with the belt around the user's waist. Optionally, this inside wall is configured to conform generally to the shaped of this front, central stomach area.

The second feature of this invention is that a light emitting device is attached to the case and positioned on the front face of the case to be observed by a third party when the belt is worn around the waist of a user. This important feature enables, for example, a personal trainer coaching the user to be alerted by the energization of the light emitting device when the user fails to keep his or her waisted pulled in to exercise the abdominal muscles.

The third feature is a strap member having one end attached to one end of the case and another end connected to the switch actuator. The strap is adjustable to fit snugly around the waist of a user, with expansion of the user's waist moving the switch actuator to change the state of the control switch, energizing the motor, vibrator, and light emitting device. Thus, when the user relaxes his or her abdominal muscles, expanding the waist, the vibrator is energized to provide the tactile alarm and the light emitting device is energized to provide the visual alarm.

The fourth feature is an enabling switch which must be closed for the vibrator and light emitting device to be energized. Preferably, this enabling switch and the light emitting device are provided in the same structure. The enabling switch allows the user to select when the belt will be used as an exercise device. When the user has completed an exercise session, the enabling switch is opened manually, so that neither the visual nor the tactile alarm is energized upon expansion of the user's waist while wearing the belt. Only when this enabling switch is closed may the visual and tactile alarms be energized.

The fifth feature is the configuration of the switch actuator, which is designed to engage an arm of the control switch, depressing this arm to change the state of the control switch. The switch actuator includes a U-shaped member with a pair of legs connected by a bite member to form opposite the bite member an open end across which a contact bar extends. The contact bar is securely attached to the open end of the switch actuator, and at least one spring normally urges the switch actuator away from the arm of the control switch so that the contact bar is in a position adjacent but spaced from the arm of the control switch. As long as the user keeps his or her stomach muscles tightened to prevent waist expansion, the switch actuator, specifically the contact bar, does not engage the arm and the control switch remains open and the motor, vibrator, and light emitting device remain deenergized. The strap has an end attached to the bite member. With expansion of the user's waist, the the strap member pulls the contact bar towards the arm of the control switch, moving into engagement with this arm to change the state of the control switch, energizing the motor, vibrator, and light emitting device.

DESCRIPTION OF THE DRAWING

The preferred embodiment of this invention, illustrating all its features, will now be discussed in detail. This embodiment depicts the novel and non-obvious exercise belt of this invention as shown in the accompanying drawing, which is for illustrative purposes only.

This drawing includes the following figures (FIGS.), with like numerals indicating like parts.

DETAILED DESCRIPTION OF THE PREFERRED EMBODIMENT

Figure 1:
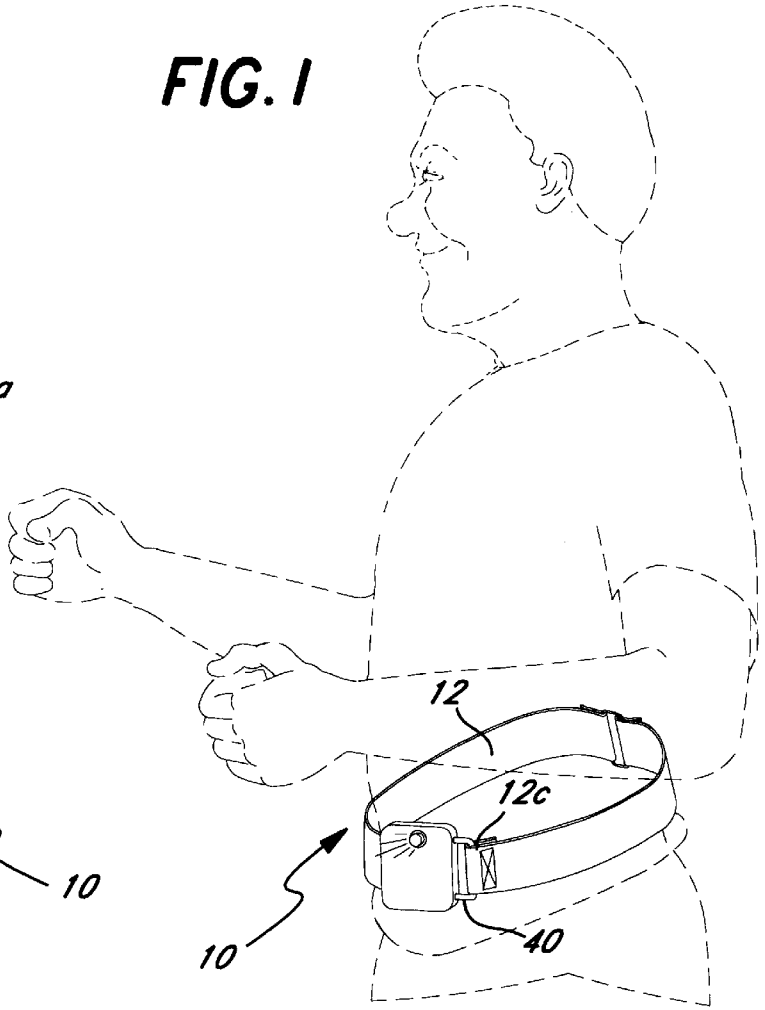
FIG. 1 is a perspective view of a user wearing the exercise belt of this invention.
Figure 2:
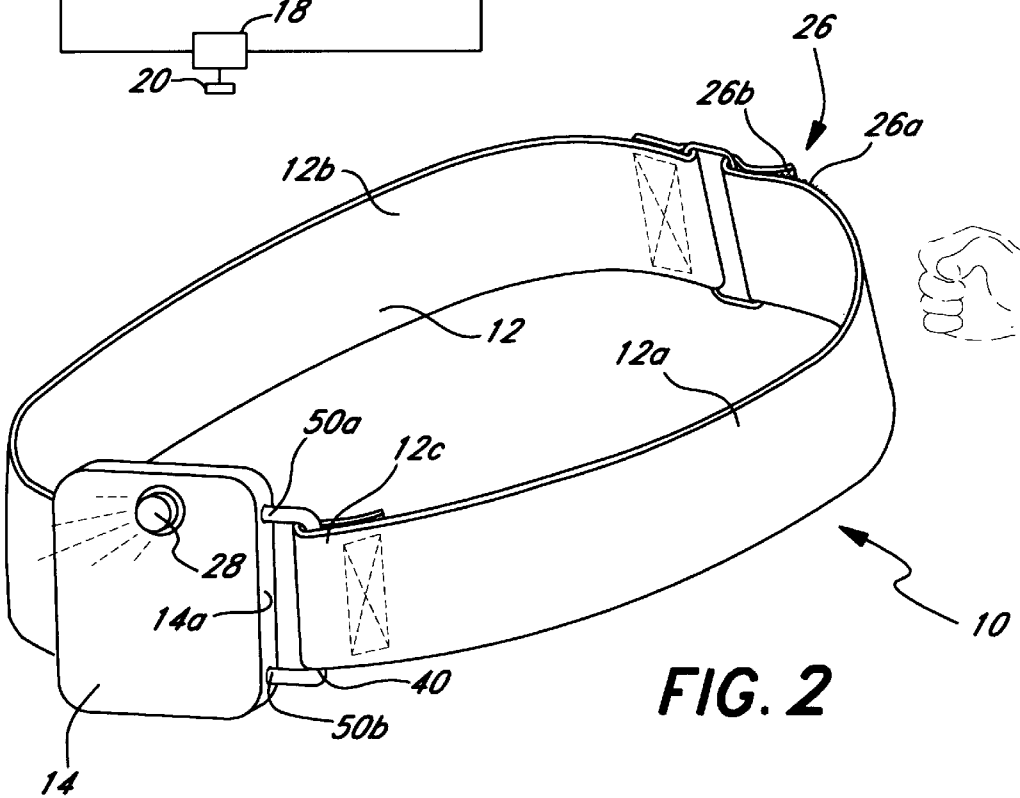
FIG. 2 is a perspective view of the exercise belt of this invention.
Figure 5:
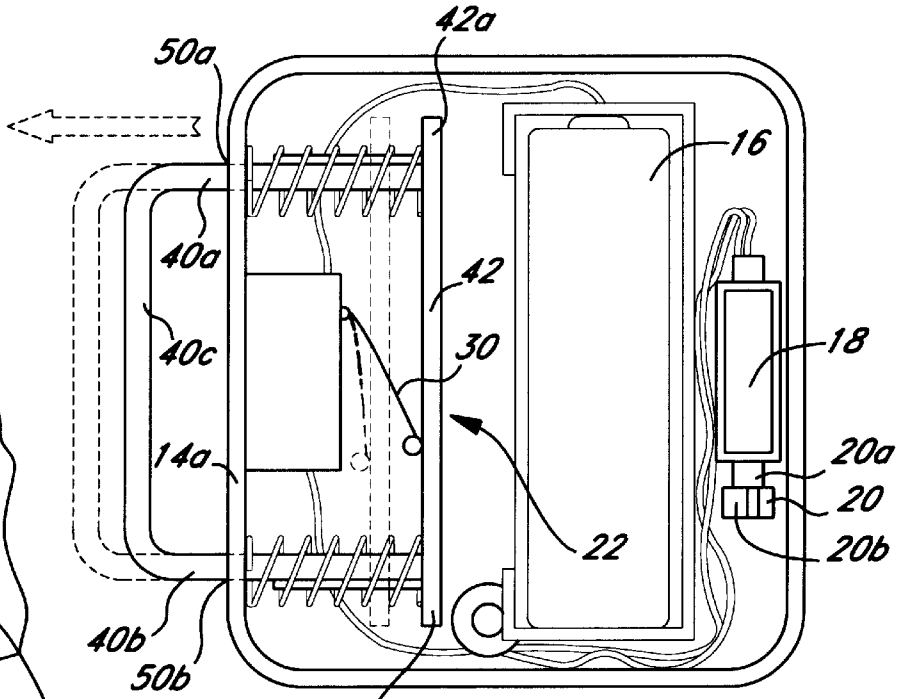
FIG. 5 is a front view of the case of the belt, with the front panel of the case removed to show the components of the invention held inside the case.
Figure 3:
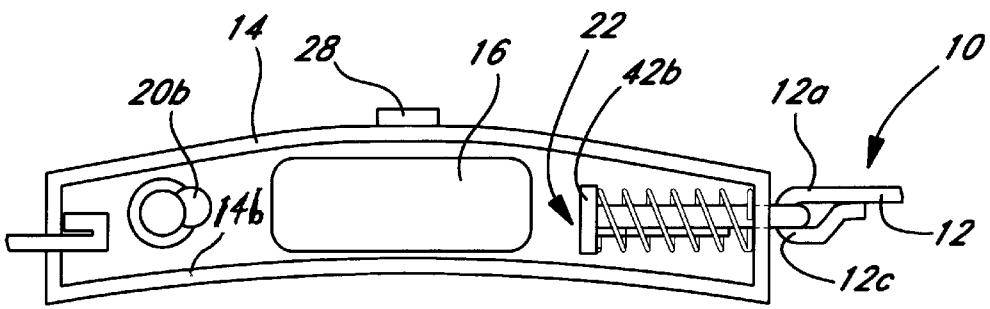
FIG. 3 is a top plan view of the exercise belt of this invention, with the top panel of the case broken away to show the components of the invention held inside the case.
Figure 6:
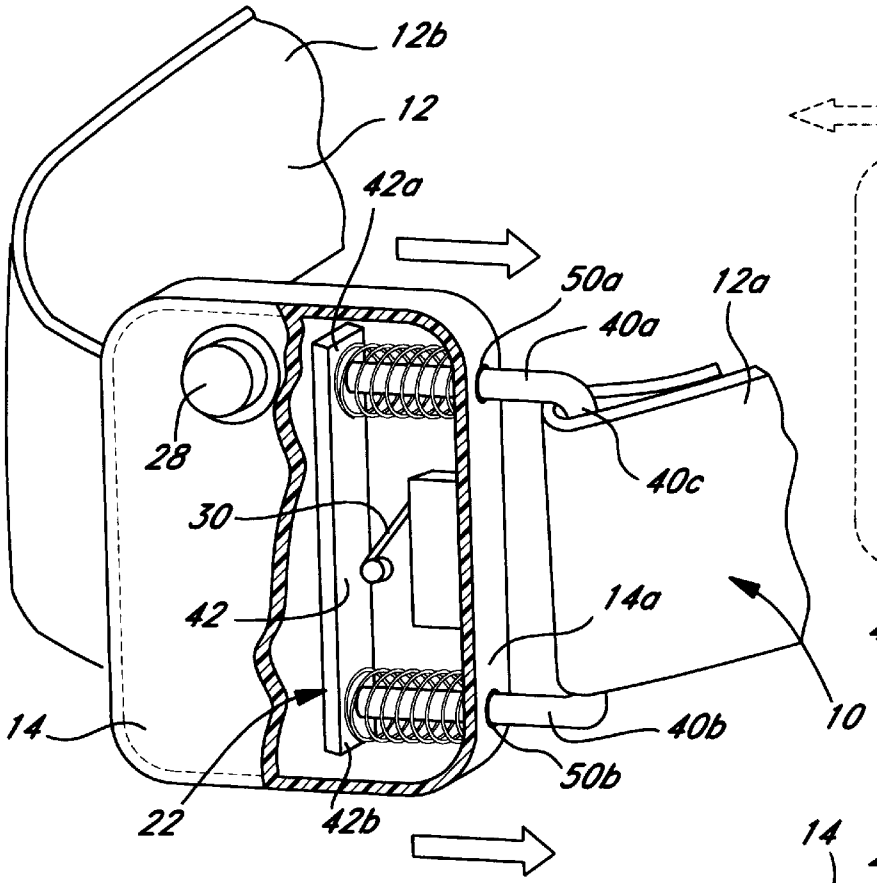
FIG. 6 is an enlarged perspective view of the belt worn around the waist of a user.

As best shown in FIGS. 1 and 5, the exercise belt 10 of this invention includes a strap 12 connected to a case 14 which holds within its interior a battery 16 (1.5 volt), a motor 18, a vibrator 20, a control switch S1, and a switch actuator 22. As best shown in FIG. 3, the case 14 is a box-like structure which has an inner wall 14*b* which has a curved shape that generally conforms to the curvature of the front, central stomach area along the waist of the user. One end of this strap 12 is securely connected to one side of the case 14 and another end of the strap 12 is securely connected to the switch actuator 22. The strap 12 has two segments 12*a* and 12*b* connected at a central portion by a hook and fabric type connector 26 such as sold under the Velcro trademark. For example, the hook portion 26*a* of this connector is on the left as shown in FIG. 2 and the fabric portion 26*b* is on the right as shown in FIG. 2. By proper placement of the hook and fabric portions 26*a* and 26*b* of the connector relative to each other, the length of the strap 12 is adjusted for the individual user so that the belt 10 fits snugly when worn about the waist of the user.

There is a light emitting device 28 mounted on the exterior of the case 14. Preferably, a switch S2 is used which includes the light emitting device 28, for example, a light emitting diode. The switch S2 thus is manually moveable between "on" and "off" positions. In the "on" position, it enables a light emitting diode to be turned on when the user fails to keep his or her waisted pulled in by tightening the abdominal muscles.

The preferred control switch S1 is of the type that essentially eliminates intermittent contact, so that the switch is either completely on or completely off. The Radio Shack sells such a control switch S1 under the trademark Zippy. This switch S1 avoids sparking contact breakdown. This control switch S1 has an arm 30 which engages the switch actuator 22 upon expansion of the user's waist beyond a predetermined width. As the arm 30 is moved inward as viewed in FIG. 5 towards the body of the switch, the switch remains off until it reaches its fully closed position shown in dotted lines. There is no sparking across any contacts which would cause intermittent operation of the vibrator 20. Only when the control switch S1 is completely closed is the vibrator 20 turned on, provided the control circuit (FIG. 4) is enabled by closure of the switch S2.

The switch actuator 22, which is designed to engage the arm 30 of the control switch S1, depresses the arm 30 to change the state of the control switch S1 when the waist of the user expands beyond a predetermined width. The switch actuator 22 includes a U-shaped member 40 with a pair of legs 40*a* and 40*b* connected by a bite member 40*c* to form opposite the bite member an open end across which a contact bar 42 extends. The one end 12*c* of the strap 12 is looped around the bite member 40*c* to attach securely this end to the bite member. The opposed ends 42*a* and 42*b* of the contact bar 42 are respectively securely attached to each leg 40*a* and 40*b* at the open end of the U-shaped member 40.

A pair of spaced apart stops 46*a* and 46*b* extend from the contact bar 42 along the legs 40*a* and 40*b*. There is a coiled spring 48*a* and 48*b* coiled, respectively, around each each stop 46*a* and 46*b* adjacent legs 40*a* and 40*b*. The legs 40*a* and 40*b* of the U-shaped member 40 extend into the interior of the case 14, passing respectively through the passageways 50*a* and 50*b* in the side 14*a* of the case 14. The coiled springs normally urge the switch actuator 22, specifically the contact bar 42, away from the arm 30 of the control switch S1, so that the contact bar 42 is in a position adjacent but spaced from the arm 30 of the control switch S1 as shown in solid lines in FIG. 5. As long as the user keeps his or her stomach muscles tightened to prevent waist expansion, the contact bar 42 of the switch actuator 22 does not engage the arm 30 and the control switch S1 remains open and the motor 18, vibrator 20, and light emitting device 28 remain deenergized. When the contact bar 42 is pulled towards the switch arm 30, the bar first moves the arm 30 to the closed position sown in dotted lines in FIG. 5 and then the stops 46*a* and 46*b* engage the side 14*a* to prevent any further movement of the contact bar 42.

Figure 4:
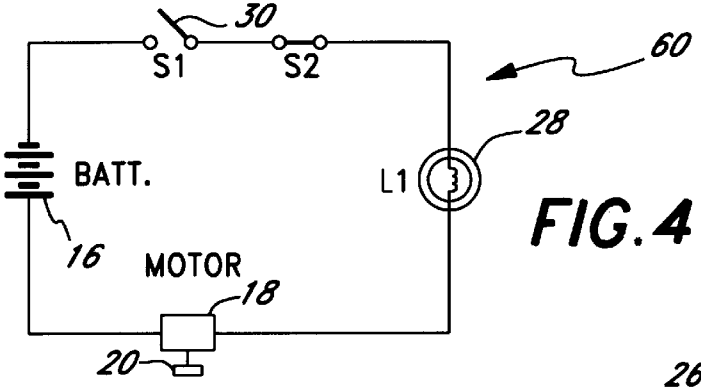
FIG. 4 is a circuit diagram of the control circuit for the exercise belt of this invention.

As shown in FIG. 4, the control circuit 60 for energizing the visual alarm, the light emitting device 28, and the tactile alarm, the vibrator 20, are energized includes the battery 16 which is in series connection with the motor 18 and the light emitting device 28. The control switch S1 and the enabling switch S2 must be closed for the circuit to be completed. To achieve this the enabling switch S2 is manually closed by moving it to the "on" position. With expansion of the user's waist, the the strap 12 member pulls the contact bar 42 towards the arm 30 of control switch S1, moving into engagement with this arm 30 to change the state of the control switch S1, closing it to energize the motor 18 and light emitting device 28. The vibrator 20 is simply a shaft 20*a* with a eccentric member 20*b* off to one side to create a vibration with the operation of the motor 18. This vibration is propagated through the case 14 and sensed by the user.

To use the exercise belt 10 of this invention, the user first places the strap 12 around his or her waist, adjusting the length of strap 12 by proper placement of the hook and fabric portions 26*a* and 26*b* of the strap segments 12*a* and 12*b* so that the belt 10 fits snugly around the waist of a user with the wall 14*b* of the case 14 snug against the front, central stomach area of the user at the user's waist. Next, the enabling switch S2 is turned on, moving it to the closed position shown in the circuit 60. The strap 12 should be adjusted so that with the abdominal muscles of the user tightened, the contact bar 42 is spaced from the arm 30, and the control switch S1 is in the open position shown in the circuit 60. As long as the user keeps his or her abdominal muscles tightened, the waist does not expand and the contact bar 42 remains spaced from the switch S1. If the user relaxes his or her abdominal muscles, the waist expands and the strap 12 pulls the switch actuator 22 to the right as shown in FIG. 5 to move the contact bar 42 into engagement with the arm 30 to close the control switch S1 and turn on the motor 18, vibrator 20, and light emitting device 28.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

We claim:

1. An exercise belt adapted to be worn around the waist of a user, including a case having opposed ends and a front and a rear face holding a control switch, a switch actuator, a battery, a vibrator, and a motor connected to the motor by the battery when the control switch changes states, said control switch being of the type that essentially eliminates intermittent contact by avoiding sparking contact breakdown, so that the switch is either completely on or completely off, a light emitting device attached to the front face of the case and positioned be observed by a third party when the belt is worn around the waist of the user for monitoring of the user's performance, enabling switch which must be closed for the vibrator and light emitting device to be energized, a strap member having one end attached to one end of the case and another end connected to the switch actuator, said strap being adjustable to fit snugly around the waist of a user with expansion of the user's waist moving the switch actuator to change the sate of the control switch, energizing the motor, vibrator, and light emitting device.

2. The exercise belt of claim 1 where the light emitting device and the enabling switch are provided in the same structure.

3. An exercise belt adapted to be worn around the waist of a user, including a case having opposed ends, an exterior with a front and rear face, and an interior holding (a) a control switch is of the type that essentially eliminates intermittent contact by avoiding sparking contact breakdown, so that the switch is either completely on or completely off, said control switch having an arm which is depressed to change the state of said control switch, (b) a switch actuator having a U-shaped member with a pair of legs connected by a bite member to form opposite the bite member an open end across which a contact bar extends, (c) a spring which normally urges the contact bar into a position adjacent but spaced form the arm of the control switch, and a light emitting device attached to the case and positioned on the exterior and front face of the case to be observed by a third party when the belt is worn around the waist of a user for monitoring of the user's performance, an enabling switch which must be closed for the motor to be energized, a strap member having one end attached to one end of the case and another end connected to the bite member of the switch actuator, said strap being adjustable to fit snugly around the waist of a user, with expansion of the user's waist moving the contact bar of the switch actuator into engagement with the arm of the control switch to change the state of the control switch energizing the motor, vibrator, and light emitting device, said spring urging the contact bar into the position adjacent but spaced from the arm of the control switch with the contraction of the user's waist, deenergizing the motor, vibrator, and light emitting device.

4. The exercise belt of claim 3 where the light emitting device and the enabling switch are provided in the same structure.

5. The exercise belt of claim 4 where the light emitting device is a light emitting diode.

6. The exercise belt of claim 3 where the case has an inside wall which abuts the stomach of the user at the user's front central stomach area with the belt around the user's waist, said wall being configured to generally conform to the shaped said stomach area.

7. An exercise belt adapted to be worn around the waist of a user, including a case having opposed ends and a front and rear face holding an enabling switch, a control switch of the type that essentially eliminates intermittent contact by avoiding sparking contact breakdown, so that the switch is either completely on or completely off, a switch actuator, a battery, a vibrator, a motor connected to the vibrator to cause said vibrator to vibrate upon energization of the motor by the battery when the contact switch changes states, said enabling switch must be closed for the motor to be energized, said case having an inside wall which abuts the stomach of the user at the user's front central stomach area with the belt around the user's waist, said wall being configured to generally conform to the shaped said stomach area, a light emitting device attached to the front face of the case and positioned to be observed by a third party when the belt is worn around the waist of a user for monitoring of the user's performance, said light emitting device and the enabling switch being in the same structure, a strap member having one end attached to one end of the case and another end connected to the switch actuator, said strap being adjustable to fit snugly around the waist of a user with expansion of the user's waist moving the switch actuator to change the state of the switch, energizing the motor, vibrator, and light emitting device.

8. The exercise belt of claim 7 where the switch actuator includes a U-shaped member with a pair of legs connected by a bite member to form opposite the bite member an open end across which a contact bar extends.

9. The exercise belt of claim 8 where the strap is attached to the another end of the strap is attached to the bite member.

* * * * *